United States Patent [19]

Rodondi et al.

[11] 4,045,112

[45] Aug. 30, 1977

[54] UNITARY INSULATOR HOUSING WITH SECONDARY LATCH MEANS AND ELECTRICAL CONNECTOR UTILIZING SAME

[75] Inventors: Andrew F. Rodondi, Sharpsville, Pa.; Martin H. Hommer, Cortland, Ohio

[73] Assignee: General Motors Corporation, Detroit, Mich.

[21] Appl. No.: 673,710

[22] Filed: Apr. 5, 1976

[51] Int. Cl.[2] ..... H01R 9/08

[52] U.S. Cl. ..... 339/99 R

[58] Field of Search ..... 339/94 RM, 97 R, 97 P, 339/98, 99 R

[56] References Cited

U.S. PATENT DOCUMENTS

| | | | |
|---|---|---|---|
| 3,804,971 | 4/1974 | Bazille | 339/98 |
| 3,824,530 | 7/1974 | Roberts | 339/99 R |
| 3,971,615 | 7/1976 | Hashimoto | 339/98 |

*Primary Examiner*—Roy Lake
*Assistant Examiner*—Mark S. Bicks
*Attorney, Agent, or Firm*—F. J. Fodale

[57] ABSTRACT

A unitary molded housing of electrically insulative material has an integrally hinged cover which is retained in the closed position by primary and secondary latch means. The secondary latch means is adjacent the integral hinge and serves to retain the cover in the closed position in conjunction with the primary latch means in the event the integral hinge fractures in service.

The housing is illustrated in conjunction with a quick splice electrical connector and features bifurcated projections on the cover which during closure of the cover aid in piercing insulation of electrical lead wires by pushing the lead wires into slotted terminals in the housing.

The housing is heat staked to retain the terminals therein and also includes means for strain relieving the lead wires having their insulation pierced by the terminals.

8 Claims, 5 Drawing Figures

UNITARY INSULATOR HOUSING WITH SECONDARY LATCH MEANS AND ELECTRICAL CONNECTOR UTILIZING SAME

This invention relates generally to a unitary molded housing of electrically insulative material having an integrally hinged cover and electrical connectors including quick splice electrical connectors utilizing such a housing.

Unitary molded housings of electrically insulative material having an integrally hinged cover moveable between open and closed positions are well known. See for instance the U.S. Pat. No. 3,835,444 granted to Roberto Plana and Francisco Villazon on Sept: 10, 1974 for a "Slotted Plate Connector." As disclosed in the aforementioned patent such covers are generally retained in the closed position by some sort of latch arrangement associated with the free end of the cover.

Arrangements such as those disclosed in the Plana patent in which the cover is attached to the body by a thin integral web, known in the art as a "living hinge," have a possible shortcoming for certain applications. Since in many applications the cover is opened and closed only a few times, the inherent relative weakness of the living hinge presents no problems. Also fracture of the living hinge and loss of the cover either because of an excessive number of openings and closings or because of in service conditions is of little or no consequence in many instances.

However in certain applications, such as those in which it is desirable to guard against exposure of uninsulated metallic or electrically conductive components or those in which the cover performs other functions, the housing arrangement exemplified by the Plana patent is inadequate.

In its broadest aspects, the object of this invention is to provide a unitary molded housing of insulating material having a secondary latch means which in conjunction with a primary latch means retains an integrally hinged cover in the closed position in the event the hinge fractures.

A more specific object of this invention is to provide such a housing with secondary latch means which for compactness and simplicity of design is placed adjacent the hinged end of the cover and which in conjunction with more or less conventional latch means at the free end of the cover retains the cover in the closed position should the hinge fracture during service.

In another aspect, this invention is concerned with electrical connectors including those of the quick splice type in which one or more lead wires are connected to one or more other lead wires via an insulation piercing type terminal or terminals secured to the ends of the first mentioned lead wires.

A quick splice type electrical connector is disclosed generally in the U.S. Pat. No. 3,408,045 granted to Turner R. Cottrell on Sept. 24, 1946 for a "Line Connector." With regards to the electrical connector aspect of the invention, this invention in addition to the objects outlined above, may also incorporate other features in the electrical connector or the housing per se.

One such feature is that the cover may be provided with a bifurcated projection (or projections) which assists in making an electrical connection between insulation piercing type terminals and insulated lead wires during closure of the cover.

Another feature is that the insulation piercing type terminals may be retained in the housing by displacing portions of the housing, such as by heat staking, resulting in a simplified terminal cavity and insulation piercing type terminal without internal latch ramps and spring fingers respectively.

Still another feature of the invention is that the housing may include means for strain relieving the lead wires which are received by the insulation piercing portions of the terminals.

Yet another feature of the invention is that the connector may be designed to connect each lead wire of a first set to a lead wire of a second set in a manner in which the uninsulated electrical connections between the respective lead wires are well insulated from each other and from the environment.

Other objects and features of the invention will become apparent to those skilled in the art as the disclosure is made in the following detailed description of a preferred embodiment of the invention as illustrated in the accompanying sheets of drawings in which.

Figure 1:
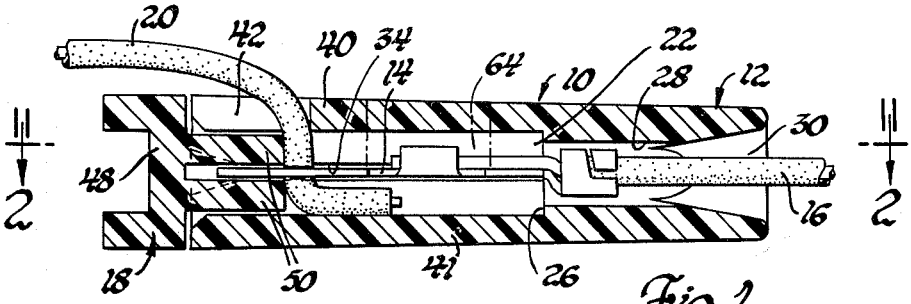
FIG. 1 is a longitudinal section through a quick splice electrical connector incorporating this invention.
Figure 2:
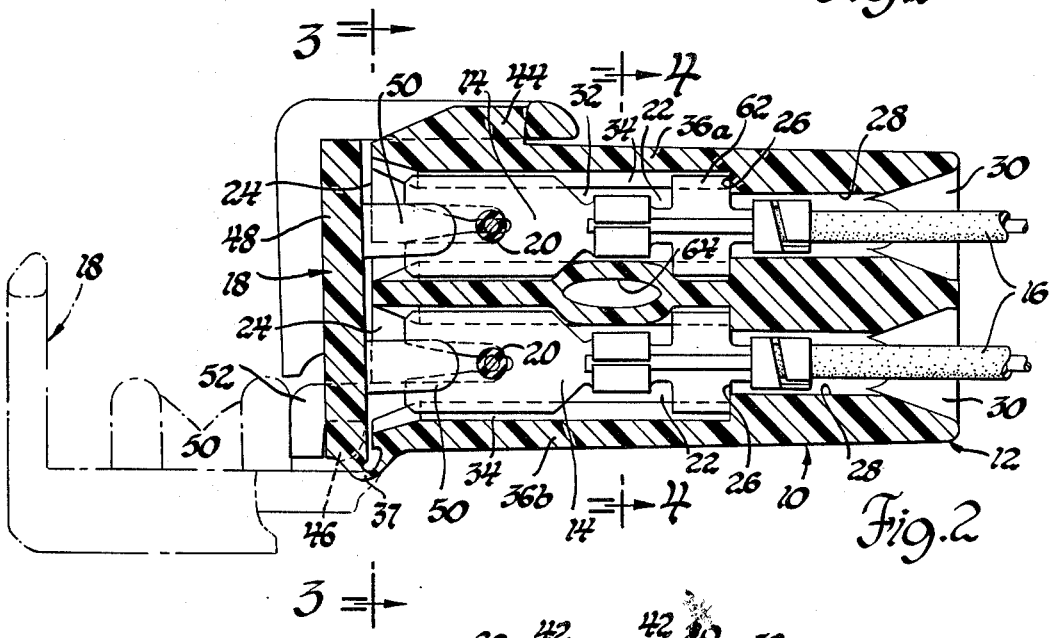
FIG. 2 is a section taken substantially along the line 2—2 of FIG. 1 in the direction of the arrows.
Figure 3:
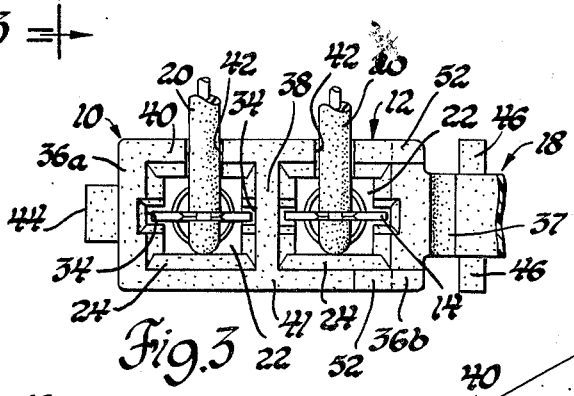
FIG. 3 is a section taken substantially along the line 3—3 of FIG. 2 in the direction of the arrows.

Referring now to the drawing, there is shown a quick splice electrical connector comprising a unitary molded housing 10 of electrically insulative material such as polypropylene. The housing 10 has a body portion 12 which retains a pair of insulation piercing type terminals 14 attached to lead wires 16 and an integrally hinged cover portion 18 which in the closed position (shown in solid lines in FIGS. 1 and 2) strain relieves the insulated lead wires 20 having their insulation pierced by the terminals 14 to make an electrical connection with their conductive cores. When the cover portion 18 is closed, the terminals 14 and uninsulated portions of their associated lead wires 16 and 20 are well isolated from each other and the outside environment.

The body portion 12 is generally rectangular in cross section and has a pair of longitudinally extending, open-ended, terminal receiving cavities 22. The cavities 22 are rectangular in cross section from the openings 24 at the forward end of the body portion 12 partway back to a forward facing shoulder 26. Each of the cavities 22 continues rearwardly from the shoulder 26 with a cylindrical portion 28 which then blends into a rectangular rear opening 30. The forward rectangular portions 32 of each of the cavities 22 communicate with two longitudinal slots 34 which are respectively in the side wall **36*a* and partition wall 38 and in the partition wall 38 and side wall 36*b*. The longitudinal slots 34 extend from the openings 24 and end at the shoulder 26. The forward rectangular portions 32 of the cavities 22 and the longitudinal slots 34 have chamfered lead-ins at the openings 24.**

The top wall 40 of the body portion 12 has two forward slots 42 which communicate respectively with the forward rectangular portions 32 of the two cavities 22.

Figure 5:
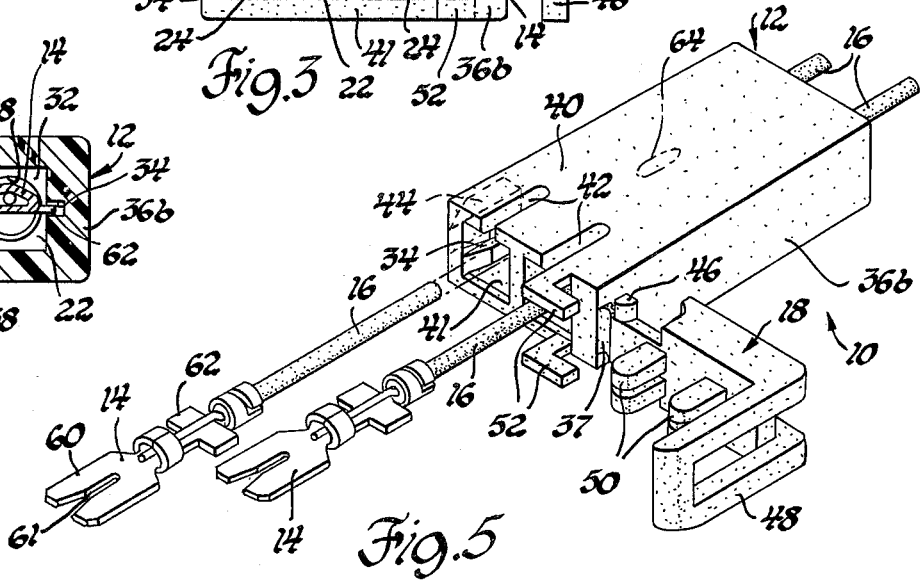
FIG. 5 is an exploded perspective view of the electrical connector shown in FIG. 1.

The cover portion 18 (shown in FIG. 5 in the position in which it is molded) is integrally hinged at the forward end of the side wall 36 by a flexible hinge portion 37 of reduced thickness which may be formed by coining the cover portion 18 (after molding) in the area where it joins the side wall 36*b*. The cover portion 18 has lateral projections 46 just outboard the hinge portion 37 and a slotted perpendicular latch arm 48 at its free end. The cover portion 18 also has two longitudinal projections 50 each bifurcated by a full depth slot which aligns with the longitudinal slots 34 of the cavities 22 when the cover portion 18 is closed.

The body portion 12 has resilient hooks 52 projecting forwardly respectively from its top and bottom walls 40 and 41 and a lock ramp 44 projecting laterally from the side wall 36*a*. The slotted latch arm 48 cooperates with the lock ramp 44 to provide a primary latch means for retaining the cover portion in the closed position. The hooks 52 cooperate with the lateral projections 46 to provide a secondary latch means for retaining the cover portion 18 in the closed position in conjunction with the primary latch means even in the event that the hinge portion 37 fractures.

The terminals 14 are insulation displacement type terminals comprising a generally conventional flat head 60 having central slots 61. The central slots 61 have a generous lead-in and rear portions which are sufficiently narrow to displace and pierce the insulation of the wires 20 received therein and make contact with the electrically conductive core. The terminals 14 have conventional crimp wings and are secured to the core and insulation of the lead wires 16 in a conventional manner. The terminals 14 also have flat stabilizing wings 62 which are located between the insulation and core crimp wings and are coplanar with the flat heads 60. The stabilizing wings 62 are used to retain the terminals 14 in the body portion 12 as will hereinafter more fully appear.

The terminals 14 are assembled to the housing by first threading the lead wires 16 through the cavities from the rear openings 30 and then crimping the terminal 14 onto ends of the lead wires 16 protruding beyond the forward openings 24. After the terminals 14 are attached to the lead wires the terminals 14 are inserted into cavities 22 with the edges of the flat heads 60 and stabilizer wings 62 disposed in the slots 34 until the rear edges of the stabilizer wings 62 abut the shoulder 26. Thereafter the top wall 40 is heat staked forming a depression 64 extending into the partition wall 38 and displacing material of the partition wall 38 into the slots 34 which prevents forward movement of the terminals 14 and retains the terminals 14 in the body portion 12.

Figure 4:
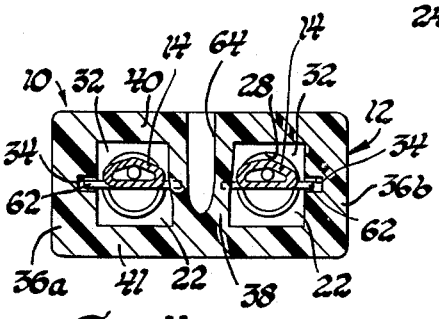
FIG. 4 is a section taken substantially along the line 4—4 of FIG. 2 in the direction of the arrows.

Once the terminals 14 are so retained, electrical connection is made between the lead wires 16 and 20 via the terminals 14 simply by inserting the ends of the lead wires 20 into the cavities 22 in the space between the terminals 14 and the bottom wall 41 and bending the lead wires 20 into the lead-in portions of the central slots 61. The cover portion 18 is then simply closed. During closure movement of the bifurcated projections 50 on the cover engage the lead wires 20 on each side of the terminals 14 and push the lead wires 20 into the narrow rear portions of the slots 61 displacing insulation and making electrical contact with the conductive cores. As the cover portion 18 is moved to the closed position shown in solid lines in FIG. 4, the flexibility of the hinge portion 37 and resiliency of the hooks 52 permits the projections 46 to snap into position in the hooks. The cover portion 18 is thus retained in closed position by cooperative engagement of the latch arm 48 and catch 44 as well as cooperative engagement of projections 46 and hooks 52. Thus the cover portion 18 will be retained in the closed position even in the event that the hinge portion 35 is fractured. It should also be noted that when the cover portion 18 is closed, the uninsulated portions of the lead wires 16 and 20 and the terminals 14 are well insulated from each other and the outside environment as there is little open space between the rear portions of the slots 42 (behind the projections 50) and the lead wires 20 while the insulation crimp wings of the terminals 14 are well ahead of the rear openings 30. Strain relief is also provided by the serpentine bending of the end portions of the lead wires 20.

We wish it to be understood that we do not desire to be limited to the exact details of construction shown and described, for obvious modifications will occur to a person skilled in the art.

What is claimed is:

1. A unitary molded housing of electrically insulative material comprising:

a body of generally rectangular cross section having a longitudinally extending open ended terminal receiving cavity, said cavity having a rearward opening for a first lead wire to extend through, and a forward opening for receiving a second lead wire to position the same in the cavity, said body having a longitudinal slot through a forward portion of a top wall which communicates with the forward opening and forward portions of the cavity, a cover connected by an integral hinge to a forward end of said body and moveable upon bending of the integral hinge about a hinge axis transverse to the longitudinally extending open ended terminal receiving cavity from an open position whereat said forward opening is freely accessible to a closed position whereat portions of said cover block said forward opening, said cover having a projection which projects rearwardly into said cavity via said forward opening when the cover is in the closed position, and means for latching said cover in the closed position, said means comprising primary latch means including a latch arm associated with the free end of the cover and secondary latch means including lateral projections integral with the cover adjacent the integral hinge which project in a direction parallel to the hinge axis and hooks axis and hooks integral with the body, said secondary latch means in cooperation with said primary latch means retaining the cover in the closed position in the event the hinge fractures.

2. The housing as defined in claim 1 wherein said body has at least two cavities, having a common partition wall parallel to a side wall, and wherein said integral hinge is connected to said side wall.

3. A unitary molded housing of electrically insulative material comprising:

a body portion having a cavity and an opening for said cavity, a cover portion connected to said body portion by a flexible hinge portion, said cover portion being moveable upon bending of said flexible hinge portion from an open position whereat said cavity is accessible via said opening to a closed latched position whereat said cover portion at least partially blocks said opening, and means for latching said cover portion in the closed latch position, said means comprising primary latch means including integral portions of the cover portion adjacent a free end thereof and secondary latch means including integral portions of the cover portion adjacent said flexible hinge portion, said secondary latch means in cooperation with said primary latch means being adapted to retain the cover portion in the closed latched position in the event said flexible hinge portion fractures, said secondary latch means comprising a pair of resilient hooks integral with said body portion and wherein said integral portions of the cover portion included in said secondary latch means comprise a base having a pair of lateral projections extending in opposite directions, said lateral projections being received in the pair of resilient hooks with the base disposed therebetween when the cover portion is in the closed latched position.

4. A unitary molded housing of electrically insulative material comprising:

a body of generally rectangular cross section having a longitudinally extending open ended terminal receiving cavity, said cavity having a rearward opening for a first lead wire to extend through, and a forward opening for receiving a second lead wire to position the same in the cavity, said body having laterally spaced walls, each with a longitudinal slot which is aligned with the other and communicates with said cavity and a top wall with a longitudinal slot through a forward portion thereof which communicates with the forward opening and a forward portion of the cavity, a cover connected by an integral hinge to a forward end of one of said laterally spaced walls and moveable between an open position whereat said forward opening is freely accessible and a closed position whereat portions of said cover block said forward opening, said cover portion having a projection which projects rearwardly into said cavity and is bifurcated to provide a slot which aligns with said longitudinal slots of said laterally spaced walls when the cover is in the closed position, and means for latching said cover in the closed position, said means comprising primary latch means including a latch arm associated with the free end of the cover and secondary latch means including lateral projections integral with the cover adjacent the integral hinge and hooks integral with the body, said secondary latch means in cooperation with said primary latch means retaining the cover in the closed position in the event the hinge fractures.

5. A unitary molded housing of electrically insulative material comprising:

a body of generally rectangular cross section having a plurality of longitudinally extending open ended terminal receiving cavities.

said cavities each having a rearward opening for first lead wires to extend through, a forward opening for receiving second lead wires to position the same therein, a forwardly facing shoulder and a forward portion of generally rectangular cross section extending rearwardly from said forward opening to said forwardly facing shoulder, said body having laterally spaced walls, each of which has a longitudinal slot in each surface defining said forward portions of said cavities which communicates with the cavity its surface defines, and aligns with the longitudinal slot communicating with the same cavity each of said last mentioned slots being midway beween a top wall and a bottom wall of said body and extending from the forward opening to the shoulder of its associated cavity, said body portion having a plurality of longitudinal slots through a forward portion of said top wall which communicate with respective ones of the forward openings and the forward portions of the cavities, a cover connected by an integral hinge to a forward end of one of said laterally spaced walls which provides one side wall for said body and moveable between an open position whereat said forward openings are freely accessible and a closed position whereat portions of said cover block said forward openings, said cover portion having a plurality of projections which project rearwardly into respective ones of said cavities and are bifurcated to provide slots which align with the longitudinal slots of said laterally spaced walls when the cover is in the closed position, and means for latching said cover in the closed position, said means comprising primary latch means including a perpendicular latch arm adjacent the free end of the cover remote from the hinge and a laterally projecting catch on another of said laterally spaced walls which provides an opposite side wall for said body and secondary latch means including lateral projections integral with the cover adjacent the integral hinge and forwardly projecting hooks integral with the top and bottom walls of the body respectively, said secondary latch means in conjunction with said primary latch means retaining the cover in the closed position in the event the hinge fractures.

6. A quick splice electrical connector for connecting one lead wire to another comprising:

a unitary molded housing of electrically insulative material having, a body of generally rectangular cross section having a longitudinally extending open ended terminal receiving cavity, said cavity having a rearward opening through which a first lead wire secured to the rearward opening, a terminal having a slot and a lead wire secured thereto, said terminal being retained in said cavity with said first lead wire extending through said rearward opening, and a forward opening adapted to receive an end portion of a second lead wire for positioning the same in the cavity, said body having laterally spaced walls, each with a longitudinal slot receiving side edge portions of the terminal and a top wall with a longitudinal slot through a forward portion thereof which communicates with the forward opening and a forward portion of the cavity, a cover connected by an integral hinge to a forward end of one of said laterally spaced walls and moveable between an open position whereat said forward opening is freely accessible and a closed position whereat portions of said cover block said forward opening, said cover having a bifurcated projection which when said cover is in the closed position projects rearwardly into said cavity and straddles said slot of the terminal and engages on opposite sides of the terminal a second lead wire engaged in said slot head with its insulation pierced thereby, and means for latching said cover in the closed position, said means comprising primary latch means including a latch arm associated with the free end of the cover and secondary latch means including lateral projections integral with the cover adjacent the integral hinge and hooks integral with the body, said secondary latch means in conjunction with said primary latch means retaining the cover in the closed position in the event the hinge fractures.

7. The quick splice electrical connector as defined in claim 6 including a second lead wire having an end portion disposed longitudinally in said cavity between said terminal and a bottom wall of said body, said second lead wire being engaged by said projections and portions of said top wall adjacent said longitudinal slot therethrough to strain relieve said second lead wire.

8. The quick splice electrical connector as defined in claim 6 wherein portions of said body are deformed into said longitudinal slots of said laterally spaced walls to retain the terminal in the cavity.

* * * * *

UNITED STATES PATENT AND TRADEMARK OFFICE

CERTIFICATE OF CORRECTION

PATENT NO. : 4,045,112

DATED : August 30, 1977

INVENTOR(S) : Andrew F. Rodondi et al

It is certified that error appears in the above-identified patent and that said Letters Patent are hereby corrected as shown below:

Column 1, line 25 "living hinge" should be quoted;

line 26 "living hinge" should be quoted;

line 56 "U.S. Pat. No. 3,408,045" should read -- U.S. Pat No. 2,408,045 --.

Column 4, claim 1, line 47 after "hinge axis" delete -- and hooks axis --;

claim 2, line 68 "latch" first occurrence should read -- latched --.

Column 5, claim 5, line 57 "cavities." should read -- cavities, --.

Column 6, claim 6, lines 45 and 46 after "having a" delete -- rearward opening through which a first lead wire secured to the --.

Signed and Sealed this

Fourth Day of April 1978

[SEAL]

Attest:

RUTH C. MASON
Attesting Officer

LUTRELLE F. PARKER
Acting Commissioner of Patents and Trademarks